US009099809B2

(12) United States Patent
George et al.

(10) Patent No.: US 9,099,809 B2
(45) Date of Patent: Aug. 4, 2015

(54) CONNECTION SYSTEM INCLUDING CONNECTOR BODY WITH INTEGRAL PRIMARY AND SECONDARY LOCK

(71) Applicant: DELPHI TECHNOLOGIES, INC., Troy, MI (US)

(72) Inventors: Terry A. George, Salem, OH (US); Christopher Adrian Margrave, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 55 days.

(21) Appl. No.: 14/108,814

(22) Filed: Dec. 17, 2013

(65) Prior Publication Data

US 2014/0206220 A1 Jul. 24, 2014

Related U.S. Application Data

(60) Provisional application No. 61/754,039, filed on Jan. 18, 2013.

(51) Int. Cl.
*H01R 13/627* (2006.01)
*H01R 13/639* (2006.01)
*H01R 13/641* (2006.01)

(52) U.S. Cl.
CPC ..... *H01R 13/6273* (2013.01); *H01R 13/639* (2013.01); *H01R 13/641* (2013.01); *H01R 13/627* (2013.01)

(58) Field of Classification Search
CPC ..... H01R 13/627; H01R 13/6273; H01R 13/641; H01R 13/639
USPC ..... 439/350, 352, 357, 358
See application file for complete search history.

(56) References Cited

U.S. PATENT DOCUMENTS 5,651,689 A * 7/1997 Plyler et al. ..... 439/352
8,235,744 B1 8/2012 Liptak et al.

* cited by examiner

*Primary Examiner* — Javaid Nasri
(74) *Attorney, Agent, or Firm* — Robert J. Myers

(57) ABSTRACT

A connector system including a first connector having a longitudinally extending lock arm defining a lock nib and attached to the first connector. The lock nib is configured to engage a primary lock tab of a second connector when the first and second connectors are in a fully mated position and the lock arm is in a resting position. The lock nib is configured to disengage the primary lock tab and engage a secondary lock tab of the second connector when the lock arm is moved from a resting to an activated position and the first and second connectors are moved to a partially mated position while the lock arm is in the activated position. The connector system generates an audible or tactile click only when the first connector is fully mated with the second connector. The connectors can be disconnected with bare hands, no tools are required.

11 Claims, 7 Drawing Sheets

CONNECTION SYSTEM INCLUDING CONNECTOR BODY WITH INTEGRAL PRIMARY AND SECONDARY LOCK

CROSS-REFERENCE TO RELATED APPLICATION

This application claims the benefit under 35 U.S.C. §119 (e) of U.S. Provisional Patent Application No. 61/754,039, filed Jan. 18, 2013, the entire disclosure of which is hereby incorporated herein by reference.

TECHNICAL FIELD OF THE INVENTION

The invention generally relates to a connection system, and more particularly relates to a connection system including a connector with an integral primary lock and integral secondary lock.

BACKGROUND OF THE INVENTION

An electrical connection system including a connector body with an integral primary lock and integral secondary lock is described in U.S. Pat. No. 8,235,744, hereinafter '744, granted to Liptak, et al., the entire disclosure of which is hereby incorporated herein by reference. Connector bodies of the type described by '744 require a tool to disengage a releasable latch means from the secondary lock. These connector bodies may also produce two audible or tactile "clicks"; the first click as the releasable latch means engages a secondary lock and then a second click when the releasable latch means engages the primary lock when the connector body is fully engaged to a mating connector body. A connector that produces a single click when it is fully engaged may be more desirable, since many service technicians are accustomed to determine that a connector is fully engaged when they detect a single click, they may leave a connector in a partially engaged position if they stop inserting the connector body after a hearing or feeling a first click rather than continuing to insert the connector body until hearing or feeling a second click.

Thus, a connector body having an integral primary and secondary lock that does not require a tool to fully disconnect and produces only a single click as it is fully engaged may yet be desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with one embodiment of this invention, a connector system is provided. The connector system includes a first connector, a second connector defining a primary lock tab and a secondary lock tab, said second connector configured to mate with the first connector, and a longitudinally extending lock arm defining a lock nib and attached to the first connector. The lock nib is configured to engage the primary lock tab when the first connector and the second connector are in a fully mated position and the lock arm is in a resting position. The lock nib is also configured to disengage the primary lock tab and engage the secondary lock tab when the lock arm is moved from a resting to an activated position and the first and second connectors are moved to a partially mated position while the lock arm is in the activated position.

In accordance with another embodiment of the invention, the lock nib comprises a pair of lock nibs protruding outwardly from a free end of the lock arm so that the free end of the lock arm defines a T shape. The primary lock tab defines two protrusions that extend upwardly from the second connector. The second connector defines a pair of walls adjacent the primary lock tab and flanking the lock arm when the first connector is mated with the second connector and wherein the secondary lock tab defines two protrusions that extend inward from the pair of walls toward the lock arm. The primary lock tab and the secondary lock tab are non-coplanar. The lock nib engages only the primary lock tab as the second connector is inserted into the first connector. The lock arm is moved from the resting position to the activated position by pressing the lock arm with a finger. The lock nib may be disengaged from the primary lock tab and the secondary lock tab without the use of tool.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1A:
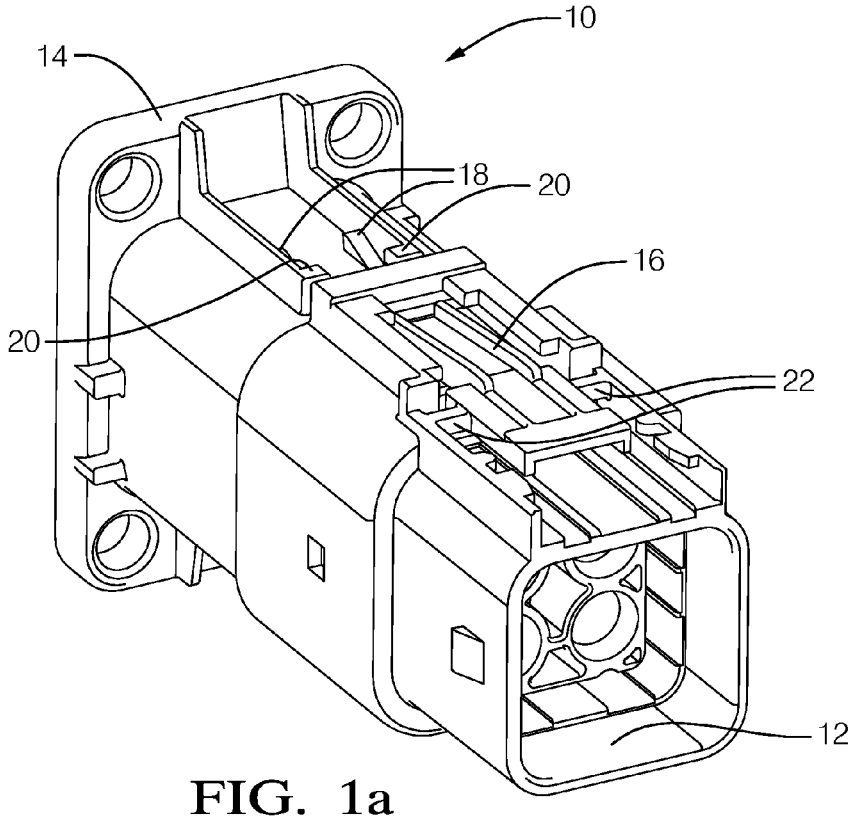
FIG. 1*a* is perspective view of a connector with a first connector and a second connector in an unmated position in accordance with one embodiment.
Figure 1B:
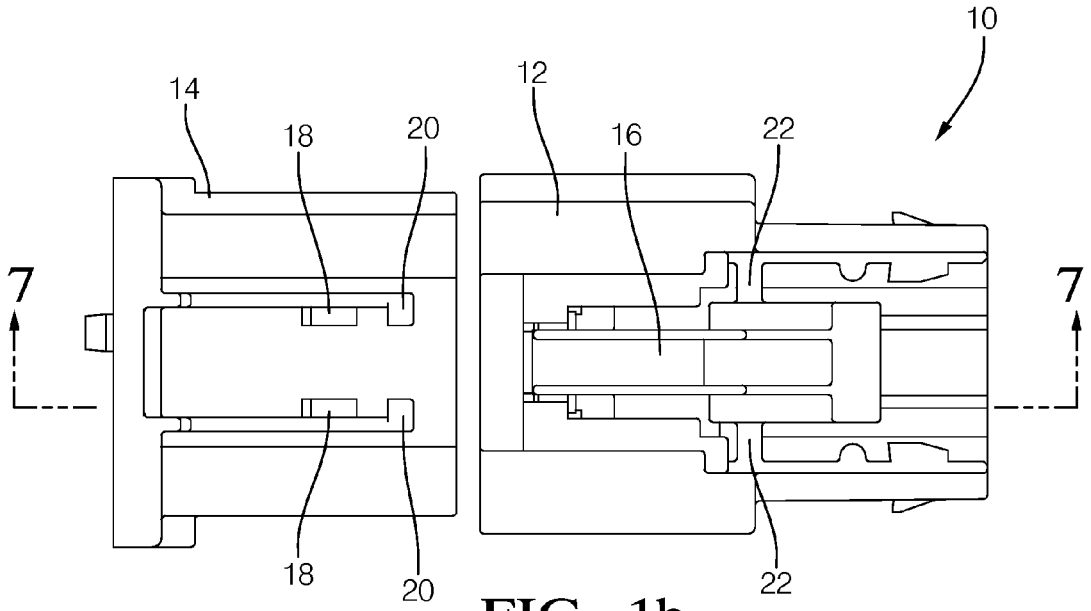
FIG. 1*b* is a top view of the connector with the first connector and the second connector in the unmated position in accordance with one embodiment.

FIGS. 1*a* and 1*b* illustrate a non-limiting example of a connector system 10 that is configured to join two electrical wiring harnesses. The connector system 10 includes a first connector 12, a second connector 14 configured to mate with the first connector 12, and a releasable latch means including a longitudinally extending lock arm 16, a primary lock tab 18, a secondary lock tab 20 and a lock nib 24 configured to secure the first connector 12 to the second connector 14 in a fully mated position when engaged with a primary lock tab 18 and configured to secure the first connector 12 to the second connector 14 in a partially mated position when engaged with a secondary lock tab 20. The first connector 12 also includes a first plurality of terminals (not shown) attached to the ends of wire cables in a first wiring harness (not shown) and the second connector 14 includes a second plurality of terminals (not shown) attached to the ends of wire cables in a second wiring harness (not shown) that are configured to mate with the first plurality of terminals. The first connector 12 and the second connector 14 are shown in an unmated position in FIGS. 1*a* and 1*b*. The first connector 12 and the second connector 14 are preferably formed of a dielectric material, such as glass-filled polybutylene terephthalate (PBT) known by various brand names such as CRASTIN, ULTRADUR, or VALOX.

The lock arm 16 is integrally formed with the first connector 12 and is formed of the same material as the first connector 12. The lock arm 16 is connected to the first connector 12 by a pair of hinge members 22 that allows the lock arm 16 to pivot about an axis A and provide a torsional force to the lock arm 16. Other embodiments of the connector system 10 may be envisioned in which the lock arm 16 and hinge members 22 are formed separately from the first connector 12.

Figure 2A:
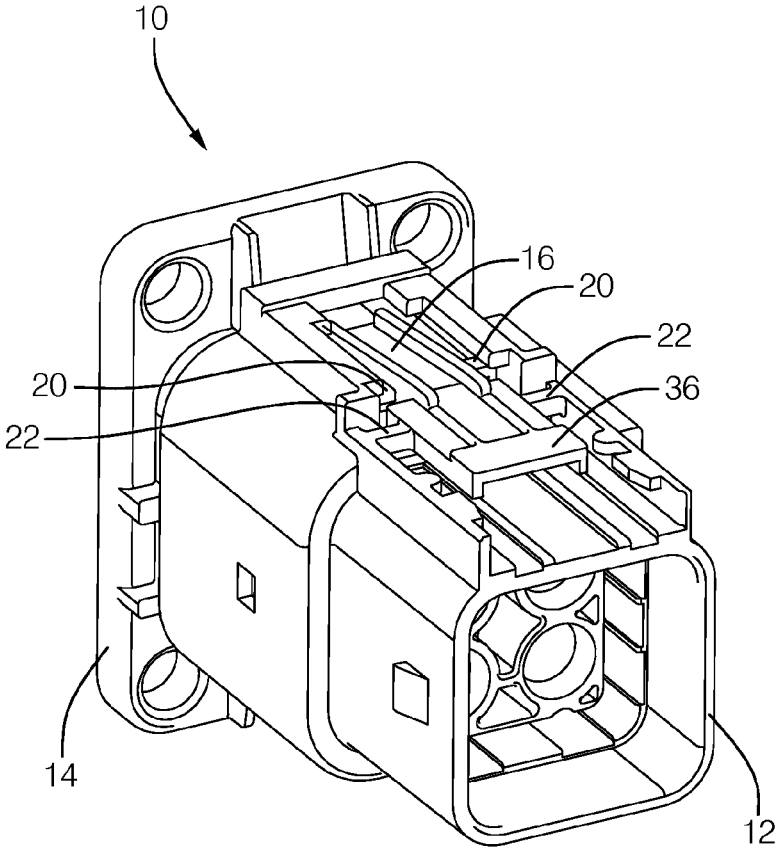
FIG. 2*a* is perspective view of the connector with the first connector and the second connector in a fully mated position in accordance with one embodiment.
Figure 2B:
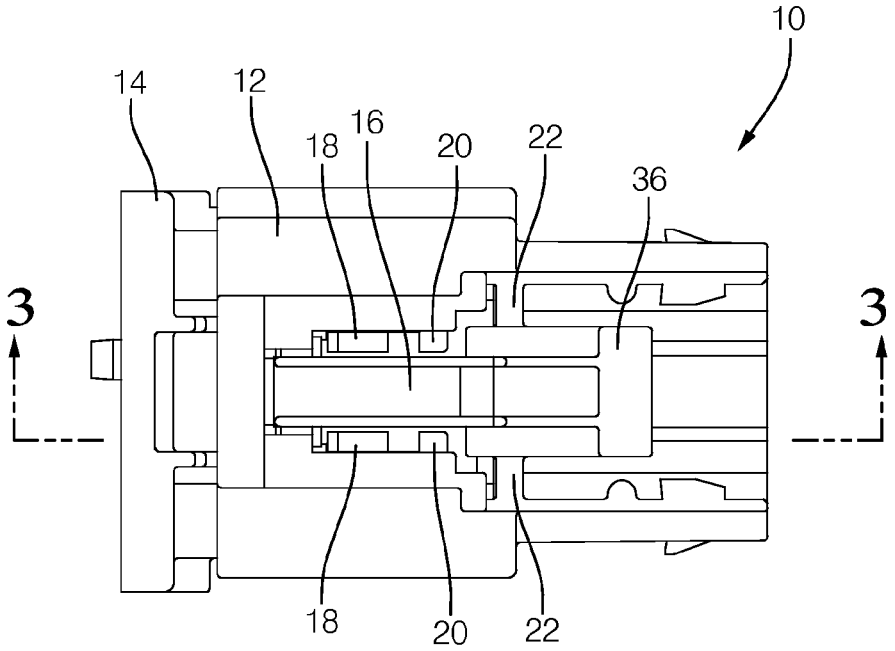
FIG. 2*b* is a top view of the connector with the first connector and the second connector in the fully mated position in accordance with one embodiment.

FIGS. 2*a* and 2*b* illustrate the connector system 10 in a fully mated position, wherein the first plurality of terminals (not shown) are engaged with and the second plurality of terminals (not shown), thereby electrically connecting the first wiring harness (not shown) to the second wiring harness (not shown). The lock arm 16 is in a resting position. As best illustrated in FIG. 2*b*, a lock nib 24 defined by the lock arm 16 engages the primary lock tab 18 integrally formed by the second connector 14 to secure the first connector 12 to the second connector 14 and inhibit relative movement between the first connector 12 and the second connector 14. In the illustrated embodiment, the lock nib 24 comprises two protrusions that extend outwardly from an end of the lock arm 16 and define a T or hammerhead shape. The primary lock tab 18 defines two protrusions that extend upwardly from the second connector 14 and engage each of the lock nibs 24. The second connector 14 defines a pair of walls that are adjacent to the primary lock tabs 18 and flank the lock arm 16 when the first connector 12 is mated with the second connector 14. The secondary lock tab 20 defines two protrusions that extend inward from the walls toward the lock arm 16.

Figure 3A:
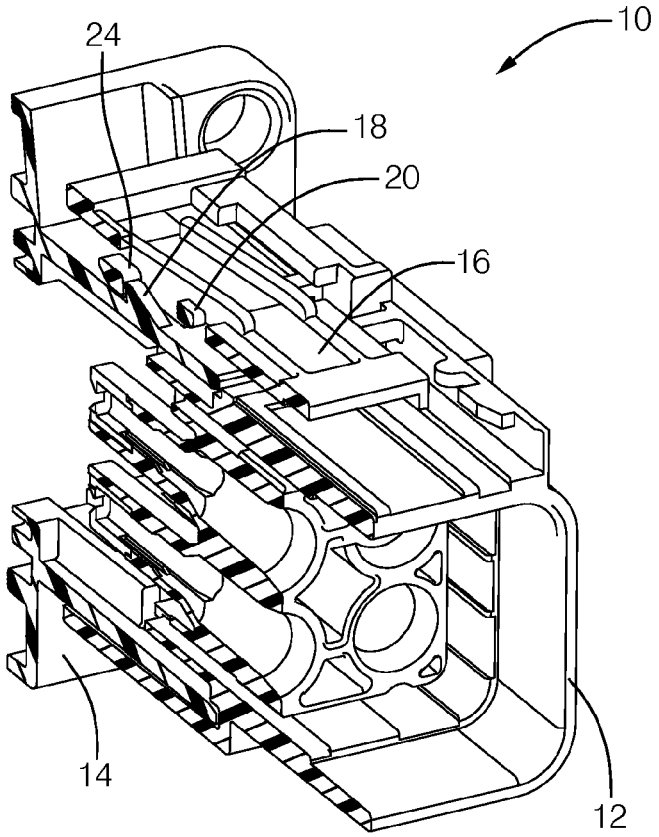
FIG. 3*a* is perspective cut away view of the connector with the first connector and the second connector in the fully mated position and the releasable latch means engaging the primary lock in accordance with one embodiment.
Figure 3B:
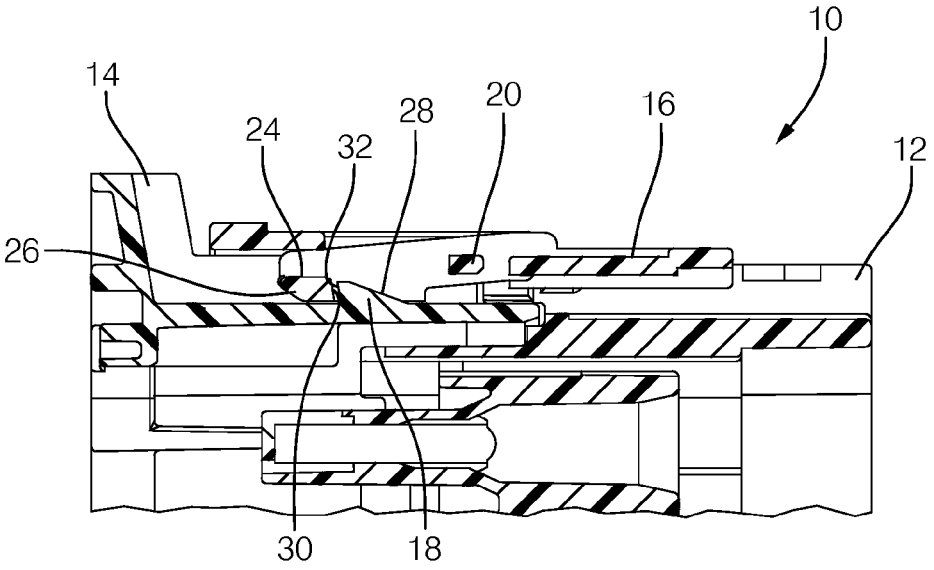
FIG. 3*b* is a partial side cut away view of the connector with the first connector and the second connector in the fully mated position and the releasable latch means engaging the primary lock in accordance with one embodiment.

FIGS. 3*a* and 3*b* illustrate cut away views of the connector system 10 in the fully mated position. Without subscribing to a particular theory of operation, when the first connected 12 is mated to the second connector 14, the second connector 14 is inserted into a shroud defined by the first connector 12 until a leading surface 26 of the lock nib 24 contacts a ramp surface 28 of the primary lock tab 18. As the second connector 14 is further inserted into the shroud of the first connector 12, the leading surface 26 of the lock nib 24 rides up the ramp surface 28 of the primary lock causing the hinge members 22 of the lock arm 16 to pivot about the axis A and generate the torsional force. The second connector 14 is further inserted into the first connector 12 until the connector system 10 is in the fully mated position whereupon a bottom surface of lock nib 24 will clear a top surface of primary lock tab 18 and the torsional force will cause the releasable latch mechanism to pivot back to its original resting position. When the lock arm 16 clears the primary lock tab 18 as it pivots back to the resting position, the connector system 10 may generate a single audible or tactile "click". In the fully mated position, a locking surface 30 of the lock nib 24 engages a locking surface 32 of the primary lock tab 18 and inhibits movement of the first connector 12 relative to the second connector 14. The height of the primary lock tab 18 is configured to that the lock nib 24 does not engage the secondary lock tab 20 when the second connector 14 is inserted into the first connector 12.

Figure 4A:
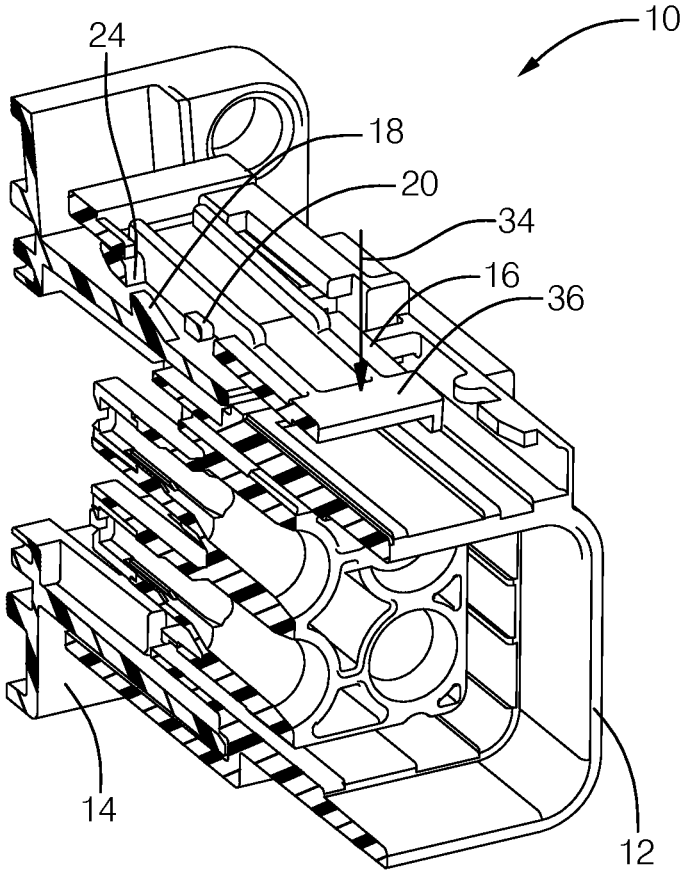
FIG. 4*a* is perspective cut away view of the connector with the first connector and the second connector in the fully mated position and the releasable latch means disengaged from the primary lock in accordance with one embodiment.
Figure 4B:
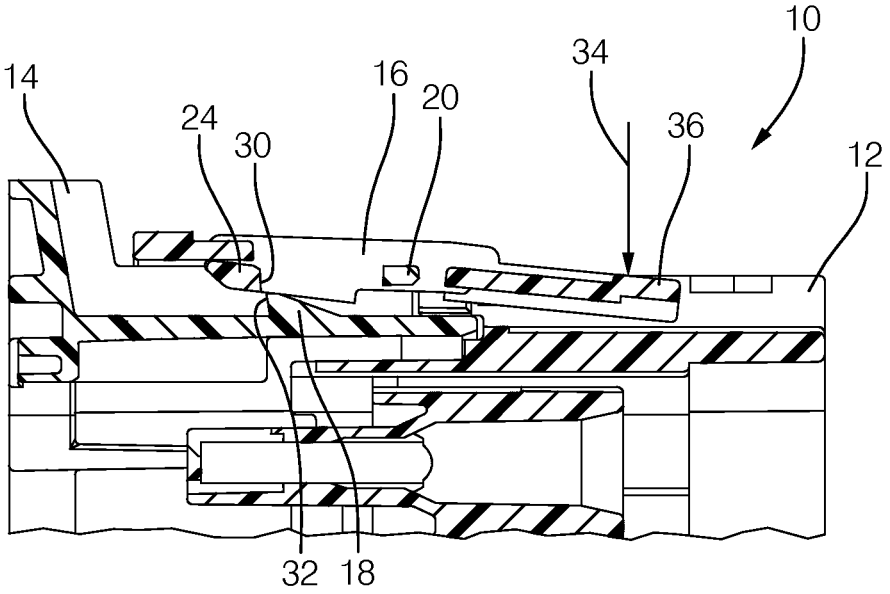
FIG. 4*b* is a partial side cut away view of the connector with the first connector and the second connector in the fully mated position and the releasable latch means disengaged from the primary lock in accordance with one embodiment.

FIGS. 4*a* and 4*b* illustrate cut away views of the connector system 10 in the fully mated position when a release force 34 is applied to a pump handle portion 36 of the lock arm 16. The release force 34 causes the lock arm 16 to pivot about the hinge members 22 and the hinge members 22 to generate the opposing torsional force and move the lock arm 16 to an activated position. The release force 34 is typically applied by a service technician pressing on the pump handle portion 36 with a finger, and therefore requires no special tools. The locking surface 30 of the lock nib 24 is no longer engaged with the locking surface 32 of the primary lock tab 18 and movement of the first connector 12 relative to the second connector 14 is no longer inhibited.

Figure 5A:
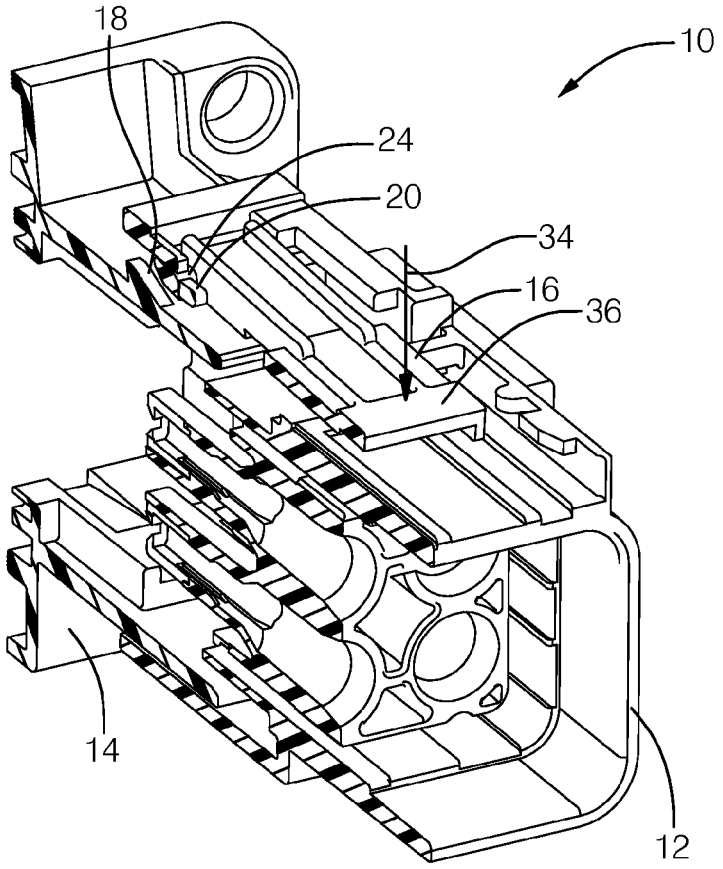
FIG. 5*a* is perspective cut away view of the connector with the first connector and the second connector in a partially mated position and the releasable latch means engaging the secondary lock in accordance with one embodiment.
Figure 5B:
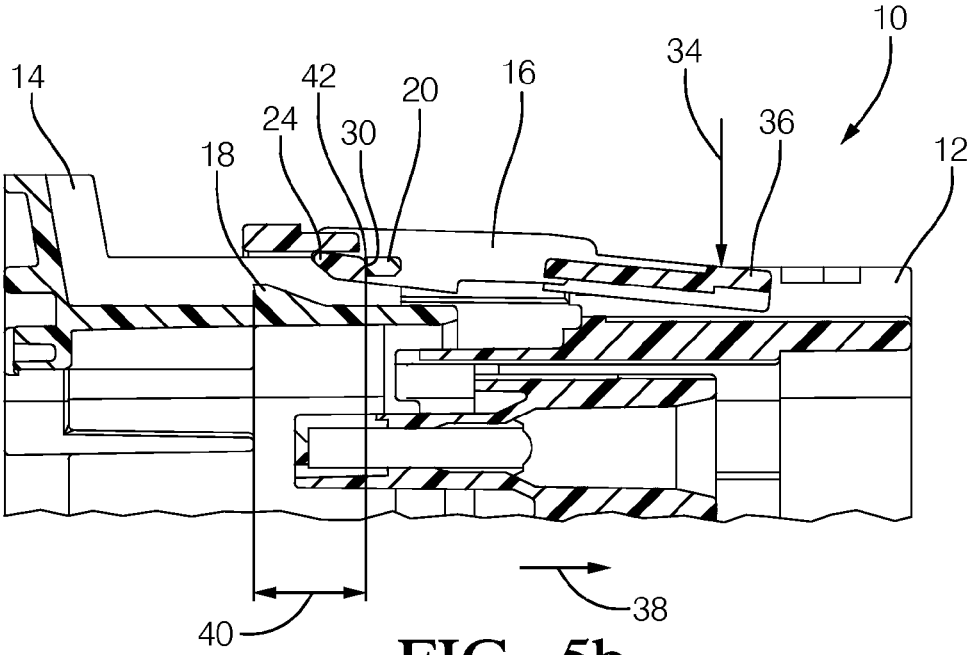
FIG. 5*b* is a partial side cut away view of the connector with the first connector and the second connector in a partially mated position and the releasable latch means engaging the secondary lock in accordance with one embodiment.

FIGS. 5*a* and 5*b* illustrate cut away views of the connector system 10 in a partially mated position with the release force 34 applied to the pump handle portion 36. The first connector 12 is moved relative to the second connector 14 in a direction 38 and a distance 40 from the fully mated position to the partially mated position. The distance 40 is preferably selected so that the locking surface 30 of the lock nib 24 can no longer engage the locking surface 32 of the primary lock tab 18. When the connector system 10 is in the partially mated position and lock arm 16 is in the activated position because the release force 34 is applied, the locking surface 30 of the lock nib 24 engages a locking surface 42 of the secondary lock tab 20 and inhibits further movement of the first connector 12 relative to the second connector 14 in the direction 38. The locking surface 42 of the secondary lock tab 20 is above and non-coplanar with the locking surface 32 of the primary lock tab 18.

The first plurality of terminals and the second plurality of terminals may be arranged within the first connector 12 and the second connector 14 so that the first plurality of terminals is disconnected from the second plurality of terminals when the connector system 10 is in the partially mated position. Alternatively, the first plurality of terminals and the second plurality of terminals may be arranged within the first connector 12 and the second connector 14 so that a first portion of the terminals are disconnected when the connector system 10 is in the partially mated position while a second portion of the terminals remain connected. Disconnecting the terminals while the first and second connectors are in a partially mated position provides the benefit of preventing the accidental contact with a disconnected terminal that may still have a voltage potential.

Figure 6A:
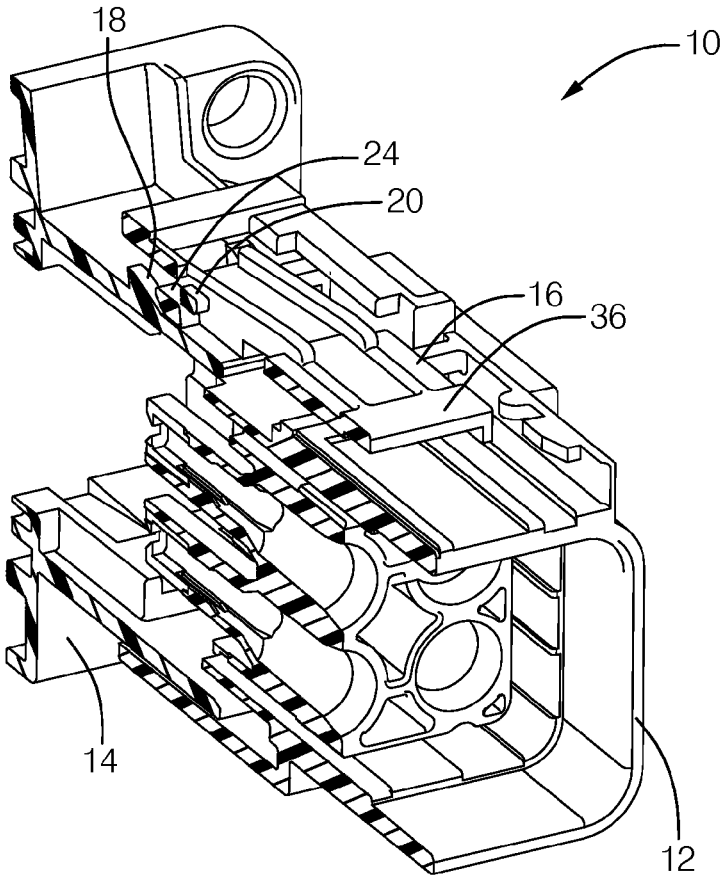
FIG. 6*a* is perspective cut away view of the connector with the first connector and the second connector in a partially mated position and the releasable latch means disengaged from the secondary lock in accordance with one embodiment.
Figure 6B:
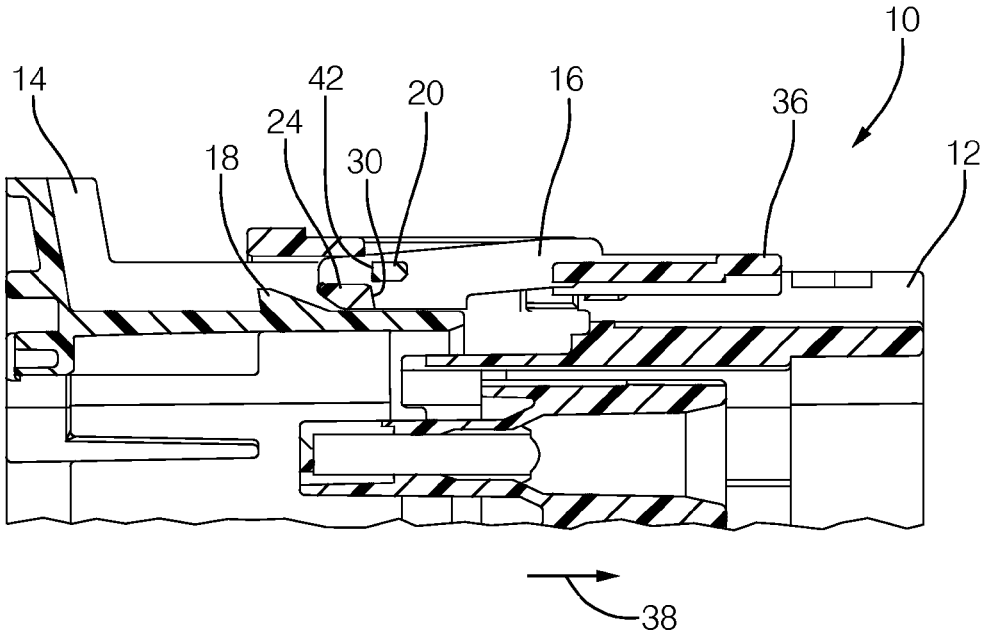
FIG. 6*b* is a partial side cut away view of the connector with the first connector and the second connector in a partially mated position and the releasable latch means disengaged from the secondary lock in accordance with one embodiment.

FIGS. 6*a* and 6*b* illustrate cut away views of the connector system 10 in a partially mated position with the release force 34 no longer applied to the pump handle portion 36. When the release force 34 is no longer applied, the torsional force will cause the releasable latch mechanism to pivot back to its original resting position. The locking surface 30 of the lock nib 24 no longer engages the locking surface 42 of the secondary lock tab 20, so movement of the first connector 12 relative to the second connector 14 is no longer inhibited in the direction 38. The lock nib 24 typically disengages the secondary lock tab 20 when the service technician removes the finger from the pump handle portion 36, and therefore requires no special tools.

Moving the first and second connectors 12, 14 from the mated position to the partially mated position and then to the unmated position introduces a time delay in disconnecting the first and second connectors 12, 14 that may allow voltage potentials on the terminals to drain away before the terminals may be contacted.

Figure 7A:
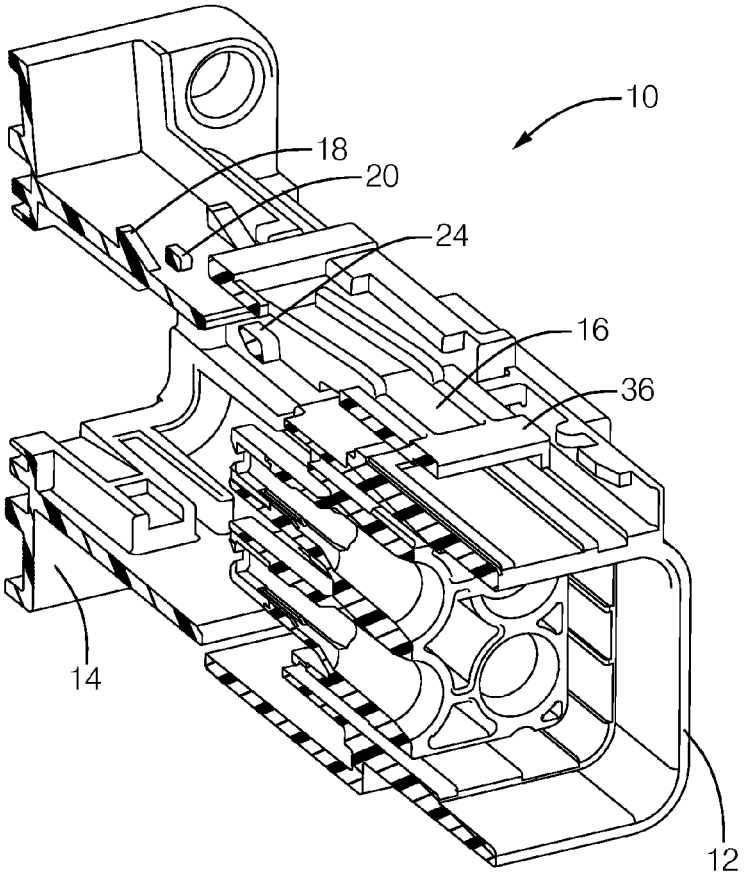
FIG. 7*a* is perspective cut away view of the connector with the first connector and the second connector in the unmated position in accordance with one embodiment.
Figure 7B:
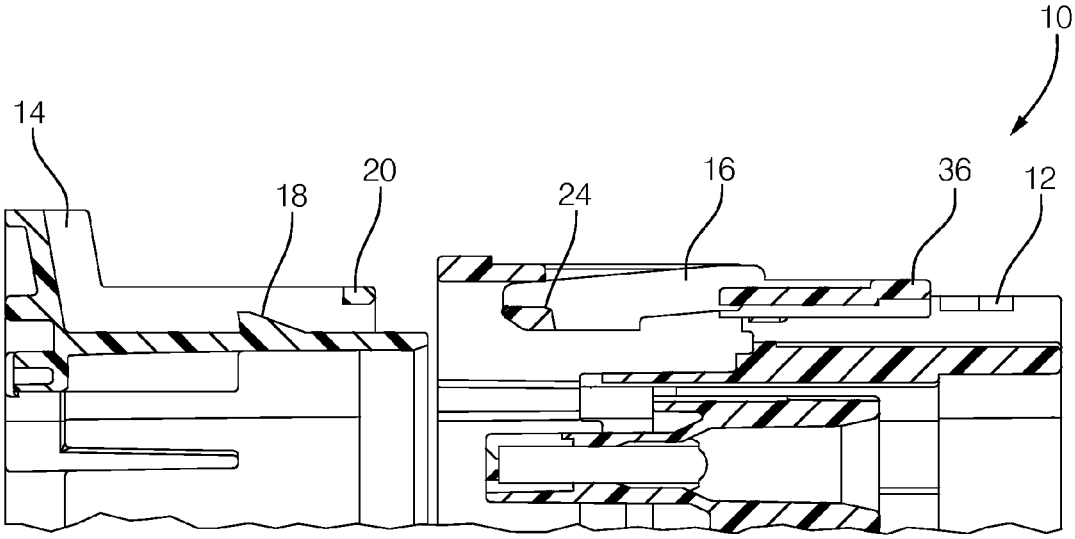
FIG. 7*b* is a partial side cut away view of the connector with the first connector and the second connector in the unmated position in accordance with one embodiment.

FIGS. 7*a* and 7*b* illustrate cut away views of the connector system 10 in a disconnected position.

The connector system 10 may further include a latch position assurance device to present the lock arm 16 from being inadvertently moved to the activated position. An example of such a latch position assurance device is described in '744 referenced in the Background of the Invention.

While the embodiment illustrated in FIGS. 1*a* to 7*b* is directed to a connector for an electrical wiring harness, other embodiments of the connector could be envisioned that are suited for connecting fiber optic cables, hydraulic fluid lines, pneumatic lines, etc.

Accordingly, a connector system 10 having an integral primary lock tab 18 and secondary lock tab 20 is provided. The connector system 10 provides the benefit of producing a single audible or tactile click only when the lock nib 24 engages the primary lock tab 18 in the fully mated position. The connector system 10 further provides the benefit of disengaging the lock nib 24 from the primary lock tab 18 and the secondary lock tab 20 using only a bare hand and without the use of any tools, such as a screwdriver, blade, pick, etc.

While the embodiments illustrated in FIGS. 1*a* to 7*b* are shown as connectors for connecting electrical wires or cables, a connector with the inventive features may be used to connect fiber optic cables, pneumatic hoses, fluid hoses, etc.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A connector system, comprising:

a first connector;

a second connector defining a primary lock tab and a secondary lock tab, said second connector configured to mate with the first connector; and a longitudinally extending lock arm defining a lock nib and attached to the first connector, wherein the lock nib is configured to engage the primary lock tab when the first connector and the second connector are in a fully mated position and the lock arm is in a resting position and wherein the lock nib is configured to disengage the primary lock tab and engage the secondary lock tab when the lock arm is moved from a resting to an activated position and the first and second connectors are moved to a partially mated position while the lock arm is in the activated position.

2. The connector system according to claim 1, wherein the secondary lock tab is distinct from the primary lock tab.

3. The connector system according to claim 1, wherein the fully mated position is distinct from the partially mated position.

4. The connector system according to claim 1, wherein the lock nib comprises a pair of lock nibs protruding outwardly from a free end of the lock arm.

5. The connector system according to claim 1, wherein the lock arm is moved from the resting position to the activated position by pressing the lock arm with a finger.

6. The connector system according to claim 4, wherein the primary lock tab defines two protrusions that extend upwardly from the second connector.

7. The connector system according to claim 6, wherein the second connector defines a pair of walls adjacent the primary lock tab and flanking the lock arm when the first connector is mated with the second connector and wherein the secondary lock tab defines two protrusions that extend inward from the pair of walls toward the lock arm.

8. The connector system according to claim 1, wherein the primary lock tab and the secondary lock tab are non-coplanar.

9. The connector system according to claim 1, wherein the lock nib engages only the primary lock tab as the second connector is inserted into the first connector.

10. The connector system according to claim 5, wherein the lock arm is integrally formed by the first connector.

11. The connector system according to claim 5, wherein the lock nib is disengaged from the primary lock tab and the secondary lock tab without the use of tool.

* * * * *